United States Patent [19]

Monroe

[11] 4,252,597

[45] Feb. 24, 1981

[54] SPLICING MACHINE AND METHOD

[76] Inventor: James M. Monroe, 1055 Logan, Apt. 1305, Denver, Colo. 80203

[21] Appl. No.: 650,416

[22] Filed: Jan. 19, 1976

[51] Int. Cl.[3] ..... B31F 5/00

[52] U.S. Cl. ..... 156/505; 156/157; 156/539; 156/542; 156/545; 270/32; 270/52; 271/157; 271/160

[58] Field of Search ..... 156/157, 252, 297, 257, 156/285, 304, 502, 505, 506, 510, 513, 539, 542, 544, 545, 566, 570, 577, 574, 579; 211/45; 214/95 R, 95 A, 99, DIG. 6; 270/61 F; 271/145, 157, 158, 159, 160

[56] References Cited

U.S. PATENT DOCUMENTS

| | | | |
|---|---|---|---|
| 1,212,341 | 1/1917 | Fowler | 271/160 |
| 1,943,390 | 1/1934 | Oser | 156/565 |
| 2,794,488 | 6/1957 | Fritzinger | 156/506 |
| 3,075,572 | 1/1963 | Catozzo | 156/505 |
| 3,363,895 | 1/1968 | Abe et al. | 270/61 F |
| 3,382,131 | 5/1968 | Morganroth | 156/505 |
| 3,769,140 | 10/1973 | Sayer | 156/544 |
| 3,773,598 | 11/1973 | Taeffner et al. | 156/505 |
| 3,776,795 | 12/1973 | Stevenson | 156/505 |
| 3,841,623 | 10/1974 | McCarthy | 271/157 |
| 3,880,699 | 4/1975 | Nishimoto | 156/304 |
| 3,919,039 | 11/1975 | Rohner | 156/562 |

*Primary Examiner*—John E. Kittle

*Attorney, Agent, or Firm*—Sheridan, Ross, Fields & McIntosh

[57] ABSTRACT

The machine comprises a splicing table with a stacking table at each end together with a vertical backboard. The splicing table fixedly abuts the backboard and the stacking tables are vertically movable in substantial abutment with the backboard. Bundles of fan-folded paper are placed on the stacking tables with their tops substantially coplanar with the splicing table. The top sheets of each bundle are swung onto the table in abutting relation, positioned by locator pins, and held by vacuum. A length of tape is drawn from a tape supply across the abutted ends and secured, and the tape is then trimmed to the width of the sheets. The vacuum hold-down is released and the second bundle is folded onto the first one. The same operation is then performed on the second and third bundles and several successive bundles.

13 Claims, 4 Drawing Figures

SPLICING MACHINE AND METHOD

BACKGROUND OF THE INVENTION

This invention lies in the field of machines and methods for endwise connection of varying lengths of paper strip material to produce bundles of such material in continuous form having a total length equivalent to a considerable number of the individual lengths. It is more particularly directed to a machine and method for re-connecting a plurality of bundles of used computer paper which were originally a continuous length but were burst or separated at the conclusion of individual programs.

The use of computers is growing rapidly throughout all types of business and industry and the use of paper is growing correspondingly. Computer printout continuous forms supplied to users comprise large bundles made up of a single length of paper perforated across its width at uniform intervals to form hinge lines and burst or separation lines dividing the entire length into a multiplicity of sheets of the same dimension which are fanfolded back and forth on each other to define a generally cubical package or bundle.

A bundle is set in place on the computer and its free end is fed into the printing section which advances the paper with sprocket wheels engaging sprocket holes in the marginal portions of the paper. As the paper leaves the computer it automatically folds into a new bundle. When a program is completed, the paper is separated at the next perforated fold line and the program is removed for further use. This process is repeated until the entire supply bundle is used up.

The used bundles are normally thrown away after analysis or other use because the computer must have a continuous supply and the used bundles are too small, varying from a few to hundreds of pages. This type of paper is very expensive and considerable loss is suffered by failure to use the unprinted side. Makeshift splicing of one bundle to another is not a satisfactory solution because the jointure must be as accurate as the original strip in order to work properly in the machine. Previous efforts to recycle this material have not met with any worthwhile degree of success.

SUMMARY OF THE INVENTION

The method and apparatus of the present invention overcome the difficulties mentioned above and provide a simple and reliable system for end-connecting a plurality of small bundles into a bundle of standard size which can be processed through a computer with the unprinted face presented to the printing apparatus and with the capability of being separated at the spliced fold lines if they occur at the end of a program.

Generally stated, the apparatus of the invention comprises a splicing table having a rear longitudinal margin and a forward longitudinal margin with a substantially horizontal planar working face, a stacking table at each end of the splicing table, and a tape supply located adjacent to the mid-portion of the length of the splicing table. Locator pins extend upward from the working face and are located near the two margins and spaced longitudinally a predetermined distance to engage the sprocket holes of two confronting end sheets of paper from two consecutive bundles and align the sheets of paper in abutting relation across the lateral axis of the table.

The stacking tables are vertically movable to support the individual bundles and the composite bundle with their top sheets substantially in the plane of the working face. Various mechanical controls may be used to set the proper levels but in the preferred form each table is yieldingly supported by one or more springs having a spring rate corresponding to the thickness-weight ratio of the paper in the bundle, or the incremental weights. This means that the force required to compress a coil spring, for example, a distance of an inch is the same as the weight of a bundle of paper an inch thick. Thus, as a bundle or bundles of paper is placed on a stacking table, the spring will yield to such an extent that the top sheet of the bundle will be in substantially the same plane as the working face of the splicing table.

The machine includes a vertical planar backboard. The splicing table abuts fixedly against the backboard and the stacking tables are closely adjacent to it. When the paper is in place, both the bundles and the top sheets contact the backboard as a guide to maintain accurate alignment. The backboard is cut away at the mid-portion of the splicing table for access to the tape supply.

In use, a stack of bundles is placed on a first stacking table and a first, single, bundle is placed on the second table, with the tops of the bundles lying substantially in the plane of the working face and with the splice margins of the top or first sheets at the ends of the bundles remote from the splicing tables. Also, the bundles are so arranged that the unprinted or white side of each sheet is uppermost. The first sheets are now folded or swung inwardly about their hinge line connections with the second sheets and downwardly onto the working face. The locator pins engage appropriate sprocket holes in the sheets and bring them into accurate alignment with their splice margins substantially abutting on a line across the width of the table, preferably with a very small gap between them. A vacuum hold down is actuated to retain the free ends in position.

A tape supply is arranged beneath and aft of the splicing table and carries a roll of suitable tape which may be paper or plastic with a suitable adhesive face which is preferably pressure sensitive. Tape is drawn from the supply directly across the line of jointure to overlie the free ends of both sheets and is pressed into securing engagement. The tape supply includes a toothed roller to form a line of perforations along the longitudinal centerline of the tape so that the joined sheets may be separated at their splice line if required at a later time. Since the sheets have been swung or folded 180 degrees the tape is applied to the used or printed side and will not interfere with subsequent printing operations by the computer. The tape is finally sheared at each side of the sheets so as not to interfere with transit through the computer mechanism.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENT

Figure 1:
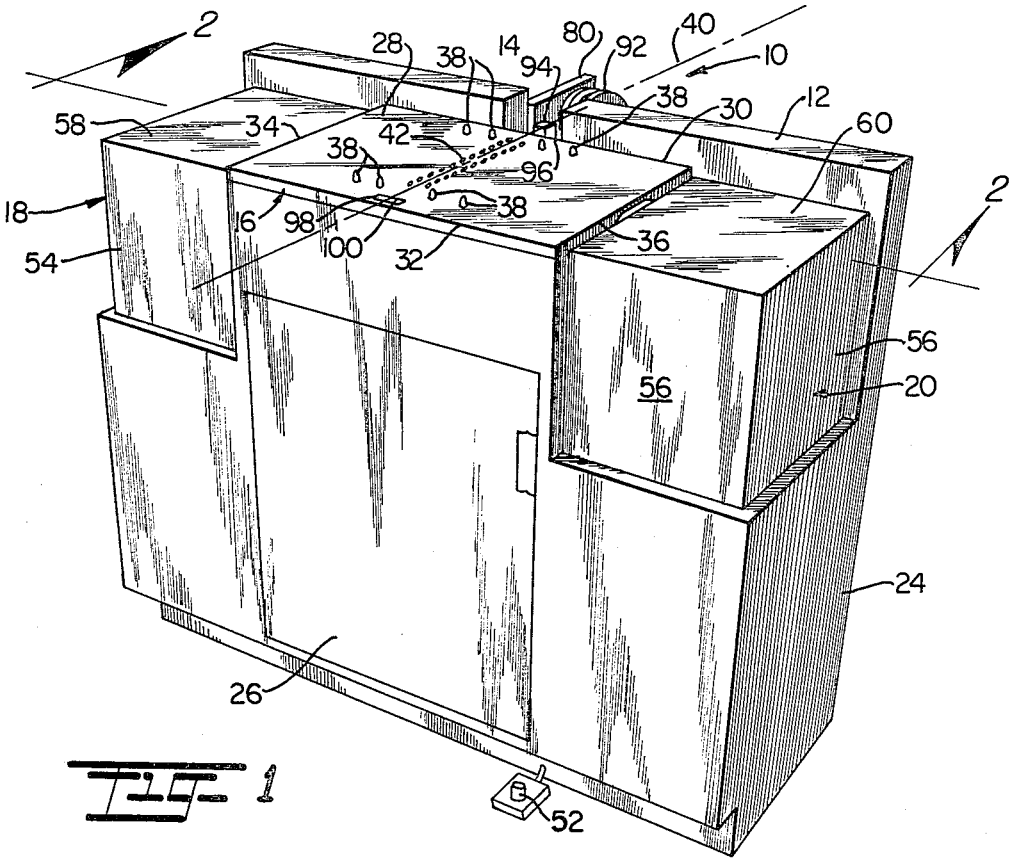
FIG. 1 is a frontal view in perspective of the machine of the invention.

The apparatus incorporating the features of the invention is generally illustrated in FIG. 1, in which splicing machine 10 includes a vertical planar backboard 12 having a generally central cut away portion 14, a plate-like splicing table 16 abutting the backboard and secured thereto, and a pair of stacking tables 18 and 20 substantially abutting the backboard and mounted for vertical movement. A vertical panel 22 having side walls 24 and a cabinet door 26 generally encloses the auxiliary equipment.

Splicing table 16 has a substantially horizontal planar working face 28 with a rear longitudinal margin 30 and a forward longitudinal margin 32 and first and second end margins 34 and 36. Four locator pins 28 extend upward from face 28 adjacent to each of the longitudinal margins and adjacent to the lateral axis 40 at the mid-portion of the table. At each margin there are two pins spaced longitudinally in each direction from the lateral axis. They are spaced from each other the proper distance to match corresponding sprocket holes in the sheets to be spliced and are so located that they will align the splice margins of two sheets in substantially abutting relation. Actually, though preferred, only one set of pins is needed in view of the vacuum means to be described.

Two rows of apertures 42, passing through table 16, extend across the major portion of the width of the table, one row at each side of axis 40. A vacuum manifold 44, best seen in FIG. 3, extends across the bottom of table 16 directly beneath the apertures and is connected by conduit 46 to a vacuum pump 48, driven by motor 50, seen in FIG. 2. A foot operated switch 52 controls the operation of the motor in conventional fashion. When the motor and pump are actuated the vacuum produced at apertures 42 serves to retain the sheets in position for splicing.

Stacking tables 18 and 20 are formed with side panels 54 and 56 forming a box-like structure and with top panels 58 and 60 to support the bundles of fan-folded paper which are to be joined. Each top panel is connected to a doubler 62 which in turn is connected to a vertical shaft 64 journaled in bearing means 66 within stanchion 68 mounted to the base plate of the machine to define the vertical path of movement of the stacking table. In each case a coil spring in compression 70 extends between the top panel 58 or 60 and a backstop 72 mounted on the stanchion to support the panels and the bundle loads placed on them. The spring rate is chosen to correspond with the incremental weight of the bundles, which means that the weight of a given thickness of the paper bundle, such as an inch, will compress the spring by substantially the same amount of one inch. Thus the top of any bundle, within suitable limits, will be approximately level with the working face of the splicing table. The stacking tables are in substantial abutment with the ends 34 and 36 of the splicing table and with the vertical face of backboard 12 and have a planform of approximately the same size and shape as a sheet of the fan-folded paper.

Figure 2:
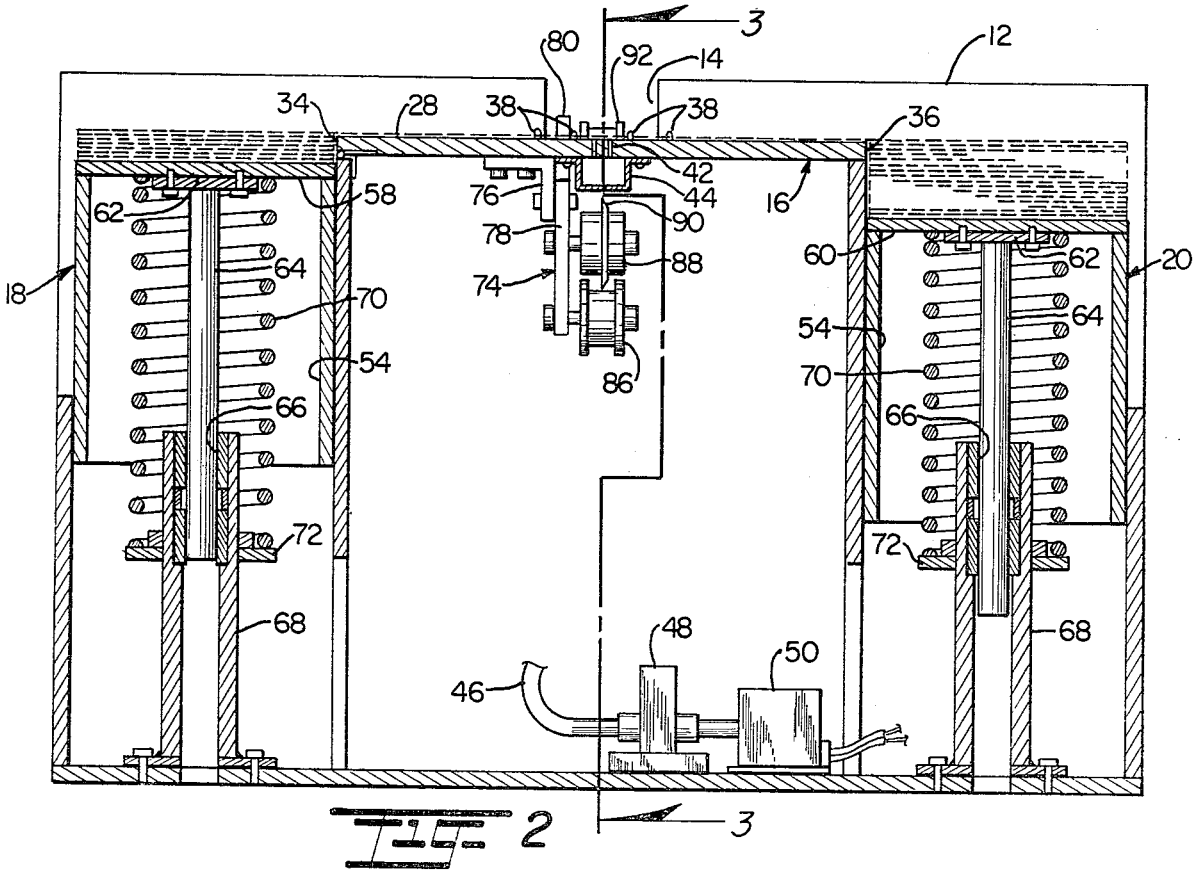
FIG. 2 is a vertical sectional view taken on line 2—2 of FIG. 1.
Figure 3:
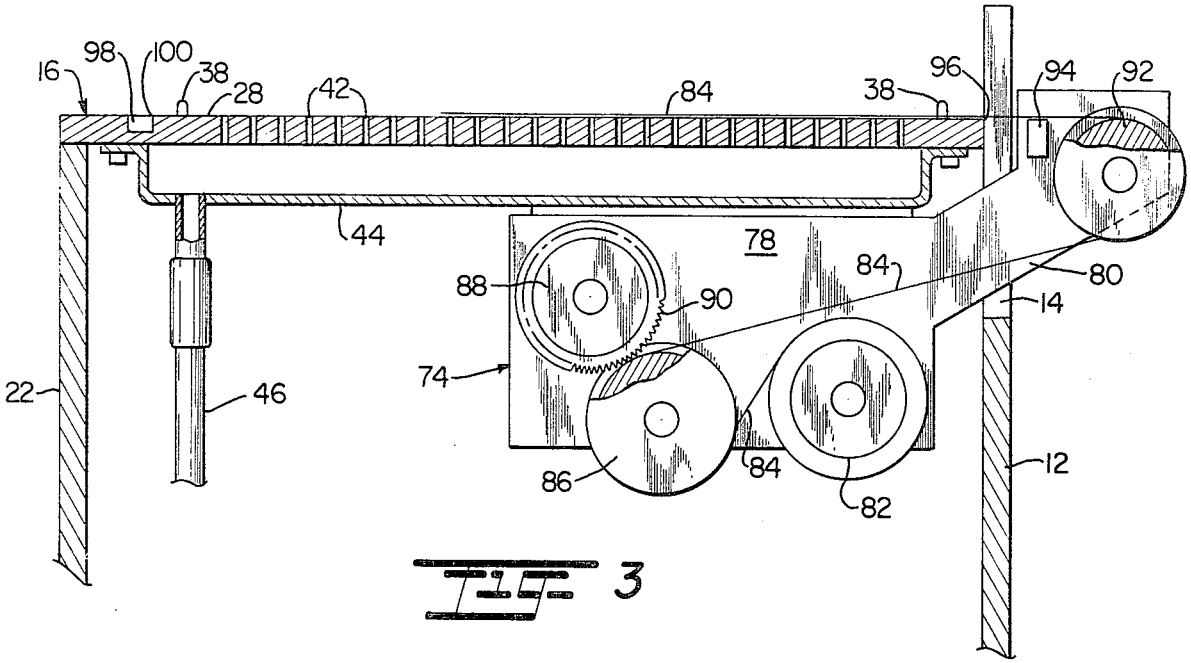
FIG. 3 is a vertical sectional view taken on line 3—3 of FIG. 2.

The tape supply is illustrated in FIGS. 2 and 3, in which a vertical plate-like bracket 74 is supported beneath the splicing table and adjacent and parallel to the lateral axis by an angle member 76. The bracket has a main plate 78 and an arm 80 extending upward and rearward through the cut-away section 14 of the backboard. Three rollers are rotatably mounted on the plate and one on the aft end of the arm. Supply roller 82 carries a supply of tape 84 which may be of any suitable type of either paper or plastic with an adhesive facing. The type presently being used with great success is Scotch 600. A standard roll is used which has the tacky side facing in.

The tape is then led over idler roller 86 which reverses its direction of travel, the tacky side facing out so that it will not stick to the roller. The third roller 88 is a perforating roller which is so placed with respect to the idler that its teeth 90 penetrate the tape as it passes to form a line of perforations along the centerline of the tape. The latter then continues rearward and upward over feed roller 92 which again reverses its direction and guides it into a path of travel extending across the splicing table on its lateral axis 40. The upper arcuate surface of roller 92 is in substantially tangential relation with the plane of working face 28. The tacky side of the tape is in contact with the roller surface and therefore the surface and preferably the entire roller is formed of a very low adhesion material such as polytetrafluoroethylene, which may be obtained under the trade name Teflon. No sticking problems have been encountered with this material. A tape anchor 94 is provided in the form of a small block mounted on arm 80 and extending across the path of the tape with its upper surface substantially coplanar with working face 28. This surface has a normal adhesion character and a length of tape may be temporarily anchored by pressing it down on the block. Here again, the anchor is desirable, but not necessary.

The mid-portion of the rear longitudinal margin 30 of the splicing table at the cut away section 14 constitutes a shearing edge 96 which may be used in cooperation with a shearing tool to trim the tape at that point, which is coincident with the rear margin of the spliced sheets. Adjacent to the forward longitudinal margin 32 of the splicing table a recess 98 is formed in the table and its inner edge 100 constitutes a shearing edge spaced from edge 96 a distance equal to the width of the sheets so that it may cooperate with the shearing tool to trim the tape at the second side of the sheets.

Figure 4:
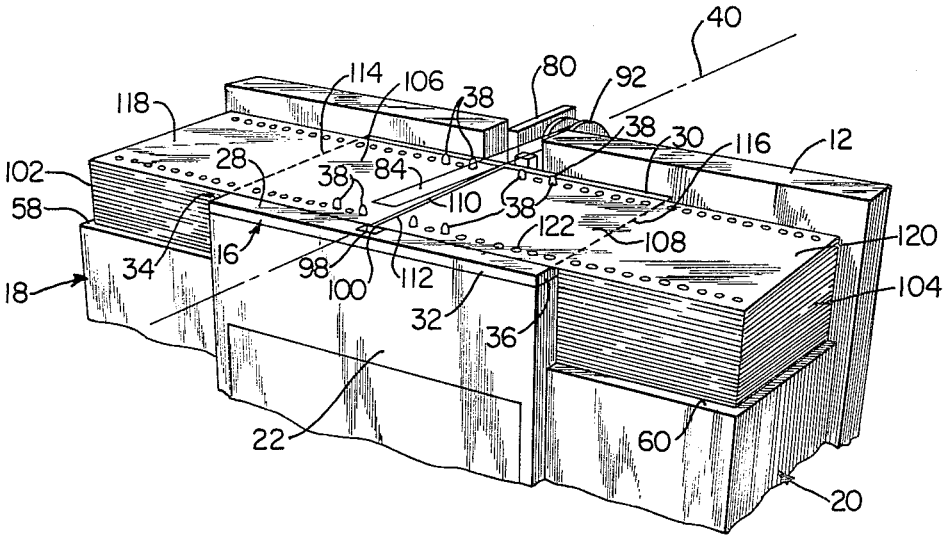
FIG. 4 is a fragmentary view similar to FIG. 1 showing a stage of the splicing operation.

The positioning and splicing operations are best illustrated in FIG. 4 where it will be seen that a stack 102 of unconnected random thickness bundles of fan-folded sheets of paper rests on top panel 58 of stacking table 18 and is positioned against the end 34 of the splicing table and against the vertical face of backboard 12. A composite bundle 104, composed of several bundles which have already been joined, rests on top panel 60 of stacking table 20 positioned in the same way as stack 102. Prior to the splice positioning shown in this figure, the first sheets 106 and 108 have been lying on top of their respective bundles with their white sides up and their splice margins 110 and 112 located at the outer sides, that is, at the opposite ends of their respective bundles from the ends 34 and 36 of the splicing table.

To come to the position shown, sheets 106 and 108 have been swung about their perforated hinge connections 114 and 116 with their respective second sheets 118 and 120 inward toward each other and downward onto the working face 28 of table 16, and the appropriate sprocket holes 122 have been pressed down onto locator pins 38 to position the sheets with their confronting splice margins 110 and 112 in substantially abutting relation across the width of the splicing table as shown. With the 180 degree reversal the printed sides of these two sheets are now uppermost.

At this point switch 52 is operated to activate motor 50 and pump 48 and produce a vacuum in manifold 44 and apertures 42 to retain the free ends of the sheets in proper relation. Tape 84 is then drawn across the table directly above the line of jointure and overlying the free ends of both sheets and is pressed down into securing relation with them. The tape is also pressed down onto tape anchor 94. The splice is not complete, and a shearing tool, not shown, is pressed down in shearing relation with shearing edges 96 and 100 to trim the tape to the width of the spliced sheets. The top bundle from stack 102 is then picked up and transferred to the other side as the upper part of the composite bundle 104. The entire process is then repeated until the composite bundle is of the desired thickness. Since shearing edge 96 is spaced forward of tape anchor 94, a short length of tape is presented for grasping by the operator during the subsequent operation. The tape is always secured to the printed sides of the sheets and will not interfere with printing operations of the computer. Of course the tape could be of the pre-perforated type in which event some of the mechanism like 90 could be eliminated.

What is claimed is:

1. A splicing machine for connecting the free ends of two bundles of fan-folded sheets of paper, comprising:

a central elongate splicing table having a rear longitudinal margin and a forward longitudinal margin and a substantially horizontal and planar working face provided with a plurality of locator pins extending above the working face and arranged adjacent to each longitudinal margin of the table and adjacent to its mid-portion;

a vertical planar backboard extending above the level of the table;

the rear longitudinal margin of the table being contiguous to the vertical surface of the backboard to cause the latter to serve as a positioning guide for the sheets to be spliced;

a vertically movable stacking table located at each end of the splicing table to support at least one bundle of sheets of paper on each table with the top of the bundle substantially coplanar with the working face of the splicing table;

the locator pins at each side of the table being longitudinally spaced a predetermined distance to engage standard sprocket holes in the marginal portions of the paper adjacent to the free ends of the sheets to be spliced and guide them into splicing position on the working face with their confronting splice margins in substantially abutting relation across the width of the table;

controllable vacuum actuated retaining means to hold the free ends of the sheets in position during the splicing operation;

and a tape supply connected to the splicing table adapted and arranged to provide a length of tape extending directly across the table to overlie the free ends of the sheets and be adhered to each of them to produce a finished splice.

2. A machine as claimed in claim 1; in which the tape supply includes a tool to form perforations in the tape along its longitudinal centerline to facilitate separation of the spliced sheets when required.

3. A machine as claimed in claim 1; in which the tape supply comprises a supporting bracket mounted beneath the splicing table;

a supply roller rotatably mounted on the bracket to carry a roll of splicing tape;

an idler roller rotatably mounted on the bracket to guide the tape in a desired direction;

a perforating roller rotatably mounted on the bracket adjacent to the idler roller positioned to contact and form a line of perforations along the longitudinal centerline of the tape;

and a feed roller rotatably mounted on the bracket in a position spaced aft of the rear longitudinal margin of the table and with its upper surface substantially in tangency with the plane of the working face of the table and aligned to engage the tape and guide it in a direction laterally across the mid-portion of the table between the locator pins at each side.

4. A machine as claimed in claim 3; in which the feed roller has a low adhesion surface to contact the adhesive face of the splicing tape.

5. A machine as claimed in claim 4; in which the surface of the feed roller is formed of polytetrafluoroethylene.

6. A machine as claimed in claim 4; in which a tape anchor is located between the table and the feed roller with its upper face substantially in the plane of the working face;

the upper face of the tape anchor having a normal adhesion surface to temporarily secure the tape against accidental displacement between splicing operations.

7. A machine as claimed in claim 1; in which the mid-portion of the splicing table has a shearing edge adjacent to each longitudinal side spaced from each other a distance corresponding to the width of the spliced sheets for cooperation with a shearing tool to trim the tape to the exact width of the sheets.

8. A machine as claimed in claim 1; in which the backboard is cut away at the central portion of the table for access to the tape supply;

the rear longitudinal margin of the table at its central portion provides a shearing edge for trimming the tape;

and a recess is formed in the working face of the forward marginal portion of the table with its inner edge spaced from the rear longitudinal margin a distance equal to the width of the sheets to serve as a shearing edge for trimming the tape to the width of the sheet.

9. A machine as claimed in claim 8; in which the backboard extends beyond the ends of the splicing table;

and the rear margins of the stacking tables substantially abut the backboard to cause the latter to serve as a guide for the bundles to maintain alignment between the bundles and the sheets to be spliced.

10. The machine as claimed in claim 1; in which the length of the splicing table is substantially equal to the combined lengths of the two sheets to be spliced to facilitate location of the bundles adjacent to each end of the splicing table.

11. The machine as claimed in claim 1; in which coil springs are provided beneath the stacking tables to yieldingly support them;

and the springs have spring rates corresponding to the incremental weights of the bundles to yield vertically a distance corresponding to the thickness of the bundle supported by each table.

12. The machine as claimed in claim 1; in which the retaining means comprises a plurality of apertures passing through the splicing table and extending across the major portion of its width at each side of its lateral axis to underlie the free ends of the sheets to be spliced;

a controllable source of vacuum;

and conduit means connecting the source to the apertures.

13. A machine as claimed in claim 12; in which an elongate vacuum manifold is mounted to the underside of the table and extends across its width directly beneath the apertures;

and the conduit means extends between the vacuum source and the manifold.

* * * * *